US012709855B1

(12) United States Patent
Manko

(10) Patent No.: US 12,709,855 B1
(45) Date of Patent: Aug. 18, 2026

(54) SEGMENTED STEEL TAPE JOINT SYSTEM FOR CONNECTING TUBULAR STEEL PILES

(71) Applicant: David Manko, Venice, FL (US)

(72) Inventor: David Manko, Venice, FL (US)

( * ) Notice: Subject to any disclaimer, the term of this patent is extended or adjusted under 35 U.S.C. 154(b) by 0 days.

(21) Appl. No.: 19/364,752

(22) Filed: Oct. 21, 2025

(51) Int. Cl.
*E02D 5/52* (2006.01)

(52) U.S. Cl.
CPC ..... *E02D 5/526* (2013.01); *E02D 2300/0034* (2013.01); *E02D 2600/20* (2013.01)

(58) Field of Classification Search
CPC ..... E02D 5/526; E02D 5/28; E02D 5/285
See application file for complete search history.

(56) References Cited

FOREIGN PATENT DOCUMENTS

| | | | | |
|---|---|---|---|---|
| AU | 2021410532 B2 | * | 11/2024 | ..... E02D 5/526 |
| CN | 112554221 A | * | 3/2021 | ..... E02D 5/285 |
| CN | 217839966 U | * | 11/2022 | |
| KR | 20180070081 A | * | 6/2018 | ..... E02D 5/285 |
| KR | 20180070481 A | * | 6/2018 | ..... E02D 5/285 |
| KR | 20190077755 A | * | 7/2019 | ..... E02D 5/526 |

* cited by examiner

*Primary Examiner* — Frederick L Lagman
(74) *Attorney, Agent, or Firm* — The Rapacke Law Group, P.A.

(57) ABSTRACT

A mechanical joint assembly for connecting tubular steel piles includes a box joint welded to a first tubular steel pile and a pin joint welded to a second tubular steel pile. The pin joint inserts into a receiving cavity of the box joint, forming an annular groove between an inner annular recess of the box joint and an outer annular recess of the pin joint. A segmented steel tape having slits across its width enables conforming to the annular groove circumference. The slits enable the tape to bend from flat configuration to circular installation through an access opening in the box joint. The mechanical connection eliminates field welding requirements while providing load transfer capacity exceeding the tensile capacity of the connected tubular steel piles. The distributed contact design reduces stress concentrations, enabling standard materials rather than specialized high-strength components, and use of standard installation tools for cost-effective connections.

20 Claims, 4 Drawing Sheets

SEGMENTED STEEL TAPE JOINT SYSTEM FOR CONNECTING TUBULAR STEEL PILES

TECHNICAL FIELD

The embodiments generally relate to mechanical joint assemblies for connecting tubular steel piles, and more specifically to segmented steel tape that provides mechanical connections for tubular steel pile installations without requiring field welding.

BACKGROUND

Conventional methods for connecting tubular steel piles in construction applications typically utilize field welding procedures that join pipe sections during installation. Traditional field welding approaches require qualified welders, 100% inspection of all welds, and significant time delays while installation crews remain on standby, resulting in substantial costs and project schedule impacts. These field welding systems present several challenges including expensive labor requirements, quality control complexities, and weather-dependent installation limitations.

Mechanical joint connections for tubular steel piles involve specific design considerations that differ from standard welded connections. Conventional mechanical joint systems frequently employ threaded, bolted, barbed, or shear key designs that function in limited applications but may experience performance issues related to assembly difficulty, material requirements, and structural capacity limitations. These mechanical joint approaches present challenges for applications requiring reliable connections that exceeds the tensile capacity of the connected tubular steel piles while maintaining ease of installation.

Existing mechanical joint assemblies generally employ designs that require precise rotational alignment, specialized installation equipment, or high-strength forged materials to achieve adequate joint capacity. Threaded mechanical joints such as Gachi-cam, High-Mecha-Neji, and Hi-SHJ designs require holding the lower pipe section fixed while rotating the upper section, creating alignment difficulties and installation torque requirements that increase with pipe diameter. Bolted joints like the KASHEEN design require numerous bolts in single shear and precise rotational alignment for assembly. Barbed joints such as Tri-Loc require large engagement forces that eliminate feasibility for tubular steel pile applications. Shear key designs like Laqnican utilize high contact pressures requiring expensive forged materials to maintain acceptable stress levels.

Alternative mechanical connection approaches including wire-based shear keys have been attempted, but contact stress limitations prevent achievement of joint capacities that exceed the tensile capacity of the connected tubular steel piles. When wire-based shear keys are sized to provide adequate contact area, the wire cannot conform to pipe circumference during installation, preventing practical implementation.

Consequently, there is a need for an improved mechanical joint system that provides reliable connections exceeding the tensile capacity of the connected tubular steel piles while enabling straightforward installation without specialized equipment or expensive materials. Accordingly, various embodiments detailed herein provide improved systems and devices for tubular steel pile mechanical connections.

SUMMARY

This summary is provided to introduce a variety of concepts in a simplified form that is further disclosed in the detailed description of the embodiments. This summary is not intended to identify key or essential inventive concepts of the claimed subject matter, nor is it intended to determine the scope of the claimed subject matter.

In one aspect, variations of the disclosed mechanical joint system may include a box joint and pin joint comprising specialized coupling components and integrated segmented steel tape mechanisms. The assembly comprises a segmented steel tape with machined slits positioned within an annular groove between coupling members, various materials for component construction, and a conformable tape mechanism configured to provide tensile load transfer through distributed contact rather than concentrated stress points. The connection mechanisms enable controlled assembly, reliable load transfer, and positive engagement through tape conformability and groove geometry, providing dependable operation while eliminating the installation complexity and material cost issues that cause performance limitations in threaded, bolted, and forged shear key applications.

In one aspect, variations of the disclosed connection system may include a mechanical joint configuration with integrated tape insertion and locking technologies. The system incorporates box and pin couplings with annular groove geometry, segmented steel tape components with slit patterns, and access opening elements configured to enable tape insertion through controlled bending during assembly procedures. The integrated design eliminates the need for field welding procedures and specialized installation equipment while providing comprehensive mechanical joint functionality with reliable tensile capacity in a single assembly unit.

In one aspect, variations of the disclosed method of mechanical joint assembly may include positioning coupling components and engaging segmented steel tape locking systems. The method involves insertion of pin joints into box joint receiving cavities while creating annular grooves through controlled positioning, followed by tape insertion through access openings rather than complex alignment procedures. The assembly process enables controlled connection, reliable load transfer, and positive engagement through tape conformability and distributed contact, creating dependable joint functionality that operates effectively with standard installation tools including hammers for tape insertion, eliminating the torque application, precise alignment, and specialized equipment requirements associated with threaded, bolted, and conventional mechanical joint installations.

Other illustrative variations within the scope of the invention will become apparent from the detailed description provided hereinafter. The detailed description and enumerated variations, while disclosing optional variations, are intended for purposes of illustration only and are not intended to limit the scope of the invention.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein.

DETAILED DESCRIPTION

Figure 1:
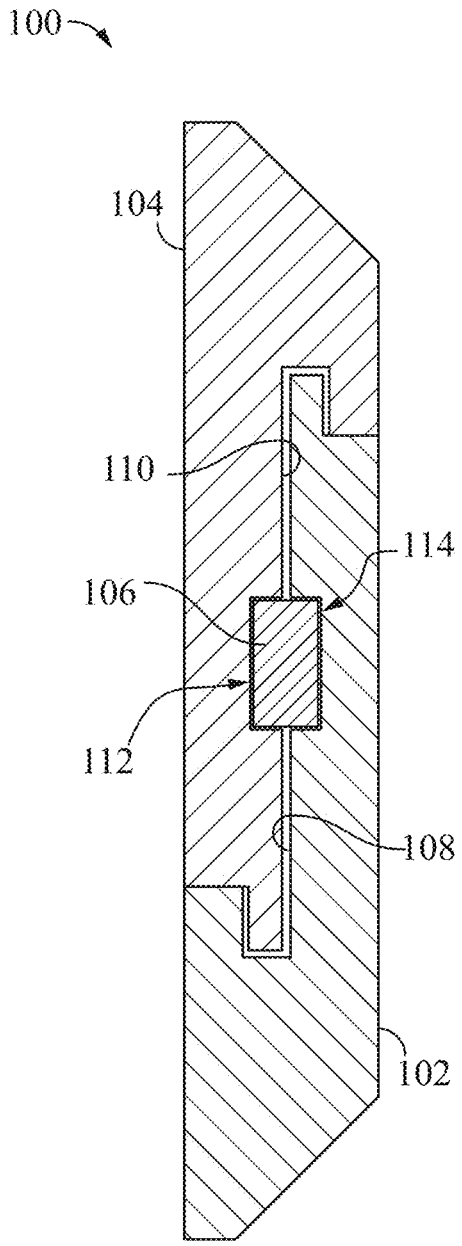
FIG. 1 illustrates a cross-sectional view of a mechanical joint assembly showing the box joint, pin joint, and segmented steel tape in assembled configuration within the annular groove, according to some embodiments.

The specific details of the single embodiment or variety of embodiments described herein are set forth in this application. Any specific details of the embodiments described herein are used for demonstration purposes only, and no unnecessary limitation(s) or inference(s) are to be understood or imputed therefrom.

Before describing exemplary embodiments in detail, it is noted that the embodiments reside primarily in combinations of components related to devices and systems. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

For clarity and consistency, the same reference numerals will be used throughout the detailed description to refer to the same or corresponding components across the various figures. When a particular component is discussed while referring to a figure different from the one in which the component first appears, the reference numeral and original figure will be cited for clarity.

Terms such as "inner," "outer," "first," "second," "box," and "pin" may be used in the following description for clarity with respect to the orientation of components as shown in the figures. These terms are not intended to be limiting and may be interpreted relative to the position or orientation of the mechanical joint assembly in actual use, which may vary.

Unless otherwise specified, the singular forms "a," "an," and "the" include plural referents. Components may be described functionally rather than structurally where appropriate for clarity. Any features or configurations disclosed as being optional or alternative may be implemented individually or in any suitable combination, as would be understood by one of ordinary skill in the art.

The disclosed mechanical joint assembly may include coupling materials formed from metallic materials that provide structural integrity while maintaining tensile load transfer capabilities compared to conventional field welded connections. The assemblies may be configured to eliminate installation complexity and material cost issues through integrated segmented steel tape mechanisms while maintaining reliable connection functionality during normal operational cycles. In some embodiments, alternative material formulations such as stainless steel or alloy steels may be used to achieve similar strength characteristics and corrosion resistance properties.

The mechanical joint assembly may comprise box joint and pin joint elements that enable controlled assembly without requiring specialized installation equipment or precise rotational alignment procedures. The connection mechanisms may be configured to provide reliable load transfer through segmented steel tape conformability and distributed contact area, eliminating the installation difficulty and performance inconsistencies typically associated with traditional threaded, bolted, and forged shear key systems. The coupling elements may be positioned through standard insertion procedures and may feature controlled groove geometry to provide tape positioning during assembly cycles. The segmented steel tape components may be configured to conform exclusively to annular groove circumferences, creating distributed load transfer that resists concentrated stress points under normal operational conditions while permitting controlled assembly without specialized equipment.

The mechanical joint assembly may also include integrated access opening systems positioned within the pin joint structure, dimensioned to provide tape insertion and conformability capabilities for controlled assembly, horizontal installation applications, or multi-directional pipe orientation requirements. These integrated components may provide reliable tape insertion surfaces while eliminating the torque application and precise alignment challenges associated with threaded connection systems and complex bolted assemblies. The access opening components may be optimized to accommodate various tape insertion requirements while maintaining the structural integrity and operational characteristics of the overall assembly.

The mechanical joint assembly may be configured to enable straightforward positioning during operation, maintaining proper load transfer and connection control without requiring specialized installation techniques or orientation-specific mounting procedures. The assemblies may be configured to engage through tape conformability and distributed contact creation, providing flexibility in mounting applications and operational configurations. The non-contact insertion connections may be configured to resist performance degradation under various loading conditions while permitting consistent operational characteristics and reapplication without degradation of the connection features.

The mechanical joint assembly may include multiple operational configurations designed for different pile installation patterns, including interior joint configurations for smooth pile driving applications and exterior joint configurations for flow restriction prevention. Each assembly type may incorporate the same tape conformability principles while providing specialized groove geometry configurations to address specific pipe diameter and wall thickness requirements.

In use, technicians or installation professionals may position the mechanical joint assembly according to pile installation requirements and engage the connection mechanisms to create reliable load transfer functionality without specialized equipment considerations. The assemblies may be installed by positioning the coupling hardware according to application requirements and connecting the box and pin joints between tubular steel pile sections. The segmented steel tape elements engage with the annular groove through controlled insertion, creating load transfer that maintains proper operational characteristics during normal pile driving cycles. The tape conformability mechanism operates through manual insertion rather than through complex alignment procedures, eliminating installation complexity and enabling consistent performance throughout the operational cycle.

A marine construction project may utilize the mechanical joint assembly to address connection reliability challenges commonly experienced when installing tubular steel piles in offshore applications where field welding creates weather delays and quality control difficulties. The elimination of welding-dependent installation prevents the operational delays and inspection requirements that often result from traditional welded connections during marine installation procedures. The consistent connection characteristics function across various pile diameters, improving installation flexibility during construction and reducing quality variations associated with field welding procedures.

A bridge construction contractor working with foundation systems and pile installations may benefit from the system's ability to maintain consistent connection performance during various pile driving operations such as battered pile installation, vertical pile operation, and variable soil condition configurations. The segmented steel tape technology maintains connection reliability without requiring the installation complexity that could restrict construction scheduling flexibility, while the equipment-independent assembly eliminates the specialized tool limitations contractors often face when specifying traditional mechanical connections for multi-diameter applications.

An infrastructure development facility may employ the mechanical joint assembly when installing foundation piles and structural support systems that operate under various loading conditions throughout the project lifecycle. The consistent connection characteristics reduce maintenance complexity during structure service life, while the reliable load transfer ensures structural integrity remains consistent during environmental loading or extended operational periods. The elimination of welding-specific installation requirements prevents construction crews from experiencing installation delays during routine pile installation procedures, improving construction consistency with project scheduling and safety protocols.

It should be noted that the use cases described above are merely illustrative examples of how the mechanical joint assembly may be utilized, and the practical applications are not limited to these specific scenarios. The equipment-independent design and consistent load transfer features make the system suitable for a wide variety of tubular steel pile applications where installation reliability, connection strength, or specialized assembly requirements provide advantages over conventional field welding and complex mechanical joint systems.

The disclosed mechanical joint assembly provides a system that offers a field welding alternative to conventional welding-specific approaches configured to address the operational challenges of tubular steel pile installation applications. By incorporating segmented steel tape technology, integrated groove geometry components, and conformable insertion systems, the assembly enables reliable connection functionality without welding-dependent dependencies while eliminating the installation complexity associated with traditional threaded and bolted connections. Unlike conventional mechanical joints that rely on precise alignment installation and create assembly difficulties across pipe sizes, this configuration provides consistent load transfer through tape conformability and incorporates equipment-independent design elements to improve installation flexibility, enabling tubular steel pile connections to proceed effectively in a variety of marine, bridge, infrastructure, and foundation applications.

FIG. 1 illustrates a cross-sectional view of a mechanical joint assembly 100 according to one embodiment of the disclosed invention. The mechanical joint assembly 100 represents a connection system designed for tubular steel pile installations that eliminates field welding requirements.

The mechanical joint assembly 100 comprises a box joint 102 that has an outer coupling member configured for welding to a first tubular steel pile during fabrication. The box joint 102 defines a receiving cavity through an inner cylindrical surface 108 that extends from an open end toward a closed end of the coupling member. The inner cylindrical surface 108 provides the mating interface for the connection system while maintaining precise dimensional tolerances for proper joint assembly. The box joint 102 further comprises at least one annular recess 114 positioned within the coupling wall structure. The annular recess 114 extends radially through the box joint 102 to provide insertion access for assembly components during field installation procedures.

The mechanical joint assembly 100 further comprises a pin joint 104 comprising an inner coupling member configured for welding to a second tubular steel pile during fabrication. The pin joint 104 has an outer cylindrical surface 110 dimensioned for controlled insertion into the receiving cavity of the box joint 102. The outer cylindrical surface 110 maintains specified clearances with the inner cylindrical surface 108 to create proper spacing for intermediate components. The pin joint 104 further comprises at least one annular recess 112 positioned within the coupling wall structure. When the pin joint 104 positions within the box joint 102, the relationship between the inner annular recess 114 and outer annular recess 112 forms a continuous circumferential channel between the coupling members.

The mechanical joint assembly 100 includes a segmented steel tape 106 positioned within the annular groove formed by annular recesses 112 and 114 between the box joint 102 and pin joint 104. The segmented steel tape 106 comprises a steel member having a predetermined width, thickness, and length configured for the specific joint diameter. The segmented steel tape 106 comprises a plurality of slits machined across the width of the steel member. The slits extend from one edge toward the opposite edge at predetermined depths based on the required bending radius and material ductility characteristics. The slits enable the segmented steel tape 106 to bend in a horizontal plane and conform to the circumference of the annular groove formed by annular recesses 112 and 114 during installation.

The pin joint 104 connects to the box joint 102 through insertion of the outer cylindrical surface 110 into the receiving cavity defined by the inner cylindrical surface 108. This insertion relationship positions the coupling members with controlled spacing that creates the annular groove formed by annular recesses 112 and 114 as the load transfer interface. The segmented steel tape 106 inserts through the access opening 116 in the exterior of the pin joint 104 and positions within the annular groove formed by annular recesses 112 and 114, with the slits providing the conformability needed to follow the circular path around the joint circumference. The segmented steel tape 106 makes contact with both the inner annular recess 114 and outer annular recess 112, creating the mechanical connection between the coupling members.

During assembly, the box joint 102 and pin joint 104 will arrive at the installation site pre-welded to their respective tubular steel pile sections, eliminating field welding operations. The pin joint 104 inserts into the box joint 102 through gravitational forces or light mechanical assistance, forming the annular groove created by annular recesses 112 and 114 automatically through their geometric relationship. The segmented steel tape 106 inserts through the access opening 116 using manual installation tools such as hammers to drive the tape into the groove while the slits enable bending around the circumference. This assembly process creates a mechanical connection that transfers tensile loads between the connected tubular steel piles through distributed contact around the joint circumference rather than concentrated stress points.

In some embodiments, the box joint 102 comprises steel construction with machined internal surfaces for dimensional accuracy. In some embodiments, the pin joint 104 utilizes stepped geometry to optimize groove dimensions for specific tape configurations. In some embodiments, the access opening 116 includes threaded interfaces for end cap installation after tape insertion.

Figure 2:
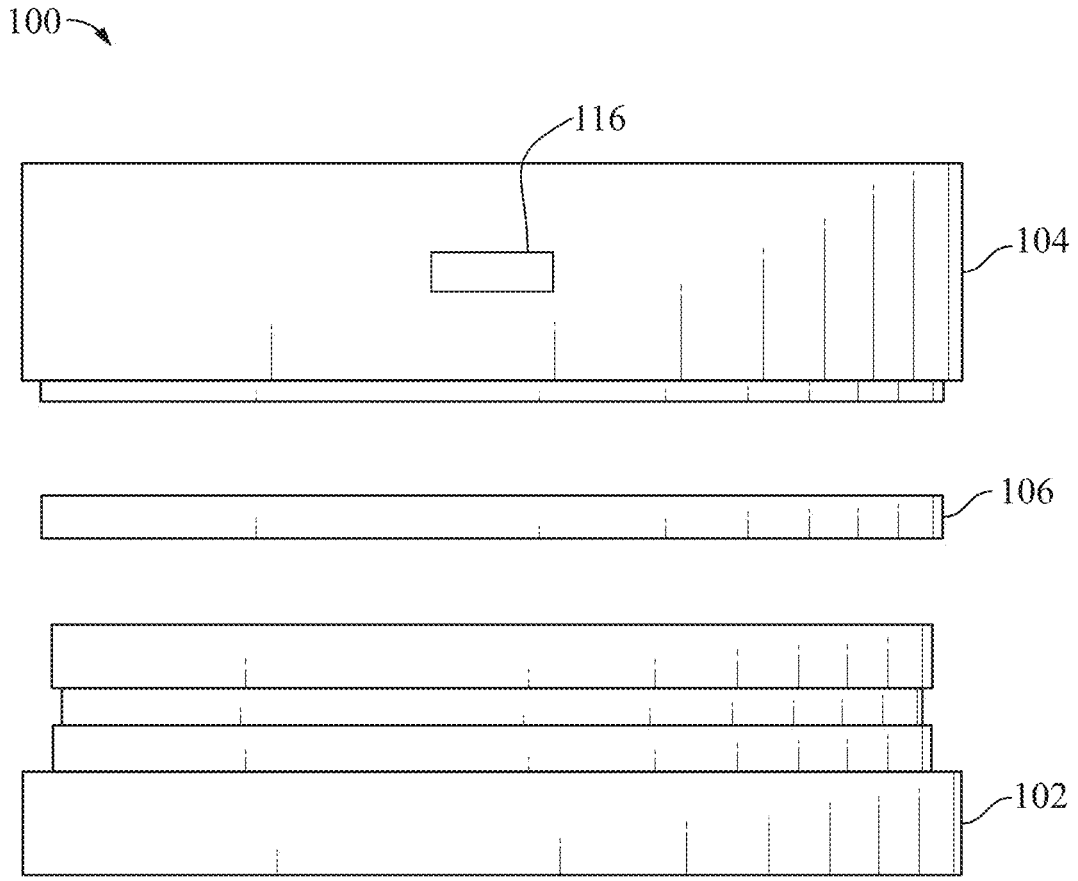
FIG. 2 illustrates an exploded view of the mechanical joint assembly of FIG. 1 showing the box joint, segmented steel tape, and pin joint, according to some embodiments.

FIG. 2 illustrates an exploded view of the mechanical joint assembly 100 of FIG. 1 showing the box joint 102, segmented steel tape 106, and pin joint 104 as separate components prior to assembly according to the same embodiment shown in FIG. 1.

The exploded configuration reveals the individual component characteristics and assembly relationships. The box joint 102 appears as the lowermost component, displaying its cylindrical form with visible receiving cavity opening. The box joint 102 exhibits mounting flanges or connection interfaces designed for permanent attachment to tubular steel pile sections. The component demonstrates the male coupling design with internal cavity dimensions that accommodate the mating component.

The segmented steel tape 106 positions as the intermediate component between the coupling members. The segmented steel tape 106 displays its flat, elongated geometry with visible width and thickness proportions. The component reveals slit patterns across its width that create the flexibility characteristics needed for curved applications. The segmented steel tape 106 demonstrates the transitional element that bridges between the coupling components during assembly operations.

The pin joint 104 appears as the uppermost component, showing its stepped cylindrical geometry with multiple diameter transitions. The pin joint 104 exhibits external surface variations that create the spacing relationships needed for proper joint function. The component displays mounting interfaces for tubular steel pile attachment and demonstrates the female coupling design with external dimensions that mate with the receiving cavity. The access opening 116 in the exterior surface of the pin joint 104 allows tangential insertion of the segmented steel tape 106.

The separation reveals the assembly sequence where components position in specific order for successful joint completion. The spacing between components illustrates the clearances needed for component insertion and positioning. The exploded arrangement demonstrates how discrete manufacturing enables quality control for each component before field assembly operations commence.

This component separation eliminates manufacturing complexity by allowing individual component optimization during fabrication. Each component may undergo specialized manufacturing processes suited to its specific requirements rather than compromise solutions needed for integrated manufacturing. The modular approach enables component standardization across different joint sizes while maintaining assembly compatibility.

In some embodiments, the box joint 102 may incorporate internal grooves or retention features for enhanced tape positioning. In some embodiments, the segmented steel tape 106 may include surface treatments such as galvanizing or coating applications for corrosion resistance or to facilitate installation. In some embodiments, the pin joint 104 may feature tapered lead-in geometry for simplified insertion during assembly. In some embodiments, the components may include alignment features such as keys or guides for proper rotational positioning. In some embodiments, multiple segmented steel tapes 106 may be utilized for higher load capacity applications. In some embodiments, the pin joint 104 may include threaded interfaces for end cap installation after tape insertion.

Figure 3:
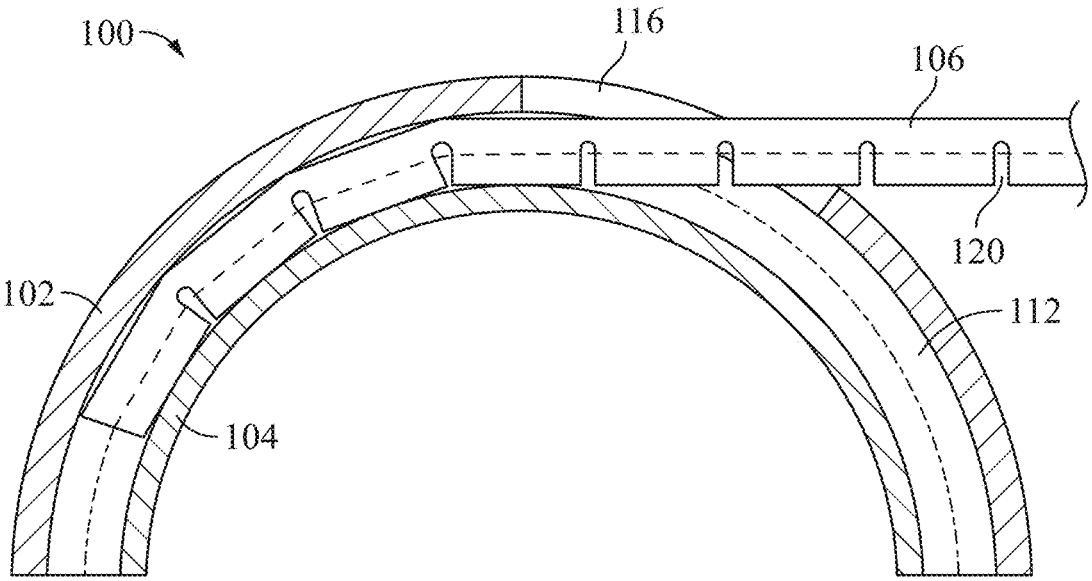
FIG. 3 illustrates a top cross-sectional technical drawing of the mechanical joint assembly of FIG. 1 showing dimensional relationships and geometric parameters of the assembled joint configuration, according to some embodiments.

FIG. 3 illustrates a top cross-sectional view of the mechanical joint assembly 100 of FIG. 1 showing the segmented steel tape 106 insertion process and sealing features during assembly according to the same embodiment shown in FIGS. 1 and 2.

The top view reveals the insertion operation where the segmented steel tape 106 enters through the access opening 116 and progresses around the circumference of the annular groove formed by annular recesses 112 and 114. The segmented steel tape 106 displays the slits 120 that function as controlled bend points across the tape width, creating individual segments connected by thin material bridges. These slits 120 enable the originally rigid steel tape to bend by allowing each segment to pivot relative to adjacent segments, similar to how individual vertebrae enable spine flexibility. As the tape encounters the circular geometry of the annular groove 112, each slit 120 closes on its inner radius, creating the controlled deformation needed to follow the curved path.

The slits 120 are machined to predetermined depths that balance flexibility requirements with structural integrity. The depth of each slit 120 determines the force required to bend the tape in conformance with the annular groove, with deeper slits allowing easier installation. The spacing between slits 120 controls the smoothness of the bend, with closer spacing creating more gradual curves that conform better to the groove geometry. The width of slits 120 is designed to ensure sufficient shear area of the tape is maintained for transferring tensile loading through the mechanical joint that exceeds the capacity of the connected tubular piles. This slit pattern transforms the flat steel tape into a flexible, segmented structure that maintains the tensile strength of the joint while gaining the conformability needed for circular installation.

The access opening 116 serves as both the entry point for tape insertion and the location for end cap installation after tape positioning. The opening accommodates insertion tools during assembly operations and provides access for driving the segmented steel tape 106 into position around the groove circumference. Following tape installation, an end cap may be secured over the access opening 116 to prevent the tape from backing out and to provide additional joint reinforcement.

The mechanical joint assembly 100 accommodates sealing elements positioned at the non-contacting interfaces between the box joint 102 and pin joint 104. O-rings may be installed within groove features to create watertight joints when required by the application. The sealing capability enables the mechanical joint assembly 100 to function in marine environments or other applications where water intrusion prevention or fluid transport is necessary.

The circumferential installation path shows how the segmented steel tape 106 achieves complete coverage around the joint perimeter. The tape may be greased prior to insertion to facilitate movement through the groove while maintaining joint integrity. The lubrication reduces insertion forces without compromising the load transfer characteristics between the coupling members.

The insertion process utilizes hammering techniques to drive the segmented steel tape 106 into position within the annular groove formed by annular recesses 112 and 114. The slits 120 accommodate the bending forces while maintaining structural continuity as the tape conforms to the circular geometry. This manual installation method eliminates specialized equipment requirements while ensuring proper tape positioning for load transfer.

The insertion process demonstrates how the segmented steel tape 106 transitions from its straight manufactured form to the curved installed configuration through the mechanical advantage provided by the slits 120. Each slit 120 acts as a hinge point that concentrates bending stress in controlled locations rather than creating uniform stress across the entire tape width. This controlled deformation enables the tape to accommodate the circular geometry while maintaining the cross-sectional area needed for load transfer between the coupling members.

The top view perspective illustrates how the mechanical connection distributes loads around the joint circumference rather than concentrating forces at discrete points. The segmented steel tape 106 creates extensive shear capacity and contact area sufficient to transfer tensile loading that exceeds the capacity of the connected tubular steel piles.

The mechanical locking action occurs when the segmented steel tape 106 positions within the annular groove formed by annular recesses 112 and 114 and creates physical interference that prevents separation of the coupling members. Once installed, the tape creates a continuous barrier around the joint circumference that mechanically locks the pin joint 104 within the box joint 102. Any attempt to separate the coupling members under tensile loading requires the tape to either shear or be withdrawn through the access opening 114, neither of which occurs under normal operational loads due to the tape's cross-sectional area and the confined geometry of the groove.

The separation resistance develops through the tape's engagement with both the inner annular recess 114 of the box joint 102 and the outer annular recess 112 of the pin joint 104 simultaneously. This dual-surface contact creates a shearing action on the segmented steel tape 106 that increases as tensile loads on the assembled mechanical joint 100 increase. The distributed contact around the full circumference ensures that separation forces are resisted uniformly rather than creating stress concentrations that could lead to premature failure. This mechanical retention system provides positive engagement that maintains joint integrity throughout the operational life of the tubular steel pile installation without requiring periodic maintenance or adjustment.

In some embodiments, the segmented steel tape 106 may provide vibration damping characteristics that reduce noise transmission during pile driving operations. In some embodiments, the tape may incorporate corrosion-resistant coatings for extended service life in marine environments. In some embodiments, multiple segmented steel tapes may be installed for enhanced load capacity in larger diameter applications. In some embodiments, multiple access openings may be provided for larger diameter pipes so that shorter, more manageable lengths of segmented steel tapes may be used. In some embodiments, the mechanical locking system may be designed for disassembly by tape removal, enabling pile section replacement without cutting operations.

In some embodiments, the end cap may be bolted into the access opening 116 for secure retention. In some embodiments, multiple O-rings may be positioned at different interface locations for enhanced sealing. In some embodiments, the segmented steel tape 106 may be installed as two segments inserted from opposite directions through the access opening 116.

Figure 4:
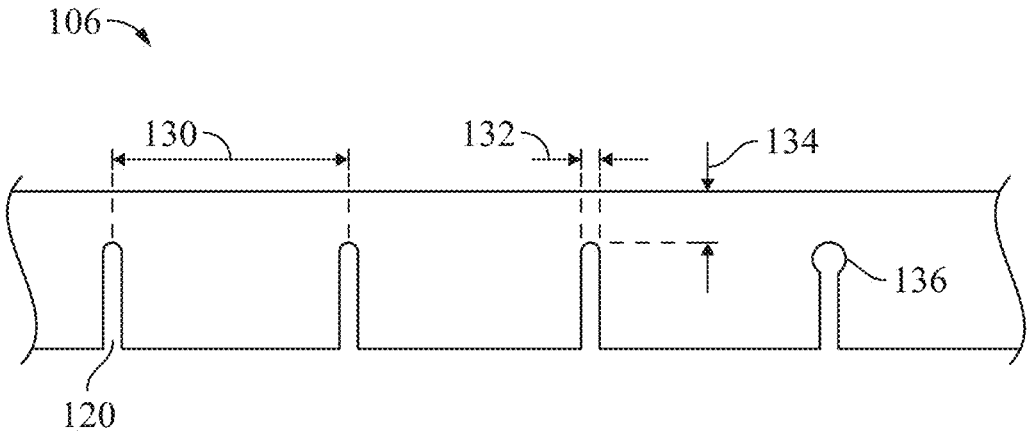
FIG. 4 illustrates a detailed view of the segmented steel tape of the mechanical joint assembly of FIG. 1 showing the slit pattern and dimensional characteristics, according to some embodiments.

FIG. 4 illustrates a detailed view of the segmented steel tape 106 of the mechanical joint assembly 100 of FIG. 1 showing the slit pattern and dimensional characteristics that enable conformability to the annular groove circumference according to the same embodiment shown in FIGS. 1-3.

The segmented steel tape 106 appears as an elongated steel member with rectangular cross-section displaying the manufactured slit pattern across its width. The slits 120 extend as cuts perpendicular to the length of the tape, creating the flexible segments that enable bending during installation. Each slit 120 penetrates from one edge of the tape toward the opposite edge, leaving connecting material that maintains structural continuity while providing controlled flexibility points.

The slits 120 function by removing material across the tape width, creating controlled deformation zones where the steel can bend without fracturing. When the tape encounters the circular geometry of the annular groove, the connecting material between slits provides hinge points for bending of the steel tape 106 in the plane of the annular groove. This creates a series of small angular deflections that cumulatively allow the tape to follow large radius curves. Without the slits 120, the steel tape would resist bending due to its geometric stiffness, requiring excessive force that could damage the joint components or prevent proper installation.

The segmented steel tape 106 demonstrates specific geometric characteristics including depth 134 and spacing 130 parameters that determine the bending capability. The depth 134 of each slit 120 establishes the amount of material remaining to transfer tensile loads through the assembled mechanical joint 100 while providing the weakness needed for controlled bending. The spacing 130 between adjacent slits 120 controls the smoothness of curvature and the minimum bending radius achievable during groove installation.

The segmented steel tape 106 includes an optional drill hole terminator 136 positioned at the end of selected slits 120. The drill hole terminator 136 provides stress concentration relief by creating a rounded termination rather than a sharp slit end. This feature reduces crack propagation potential during bending operations and enhances the fatigue resistance of the tape under repeated loading conditions.

This conformable steel tape design eliminates the standard practice of field welding tubular steel piles by providing a mechanical connection alternative that exceeds the tensile capacity of the connected tubular steel piles. Traditional field welding requires qualified welders, 100% inspection procedures, and hours of installation time while crews remain on standby, creating substantial project costs and schedule delays. The segmented steel tape 106 installation requires only basic tools and manual labor, completing connections in minutes rather than hours while eliminating weather-dependent welding limitations and quality control complexities.

The slit pattern transforms the rigid steel member into a conformable element that can be manufactured in controlled factory conditions and installed using standard construction techniques. This approach eliminates the specialized equipment, certified personnel, and inspection requirements associated with field welding while providing reliable load transfer that exceeds the tensile capacity of the connected tubular steel piles.

The detailed view reveals how the slits 120 enable field assembly without compromising structural performance. The remaining material between slit ends provides the load-bearing cross-section that transfers tensile forces between coupling members while the slit openings accommodate the geometric requirements of circular installation through simple hammering techniques. In some embodiments, the slits 120 may include tapered profiles that vary in width from the inner to outer radii of the annular groove.

Embodiments of the present disclosure provide various methods for connecting tubular steel piles using mechanical joint assemblies to eliminate field welding requirements, such as described herein. Various examples of the operations performed in accordance with some embodiments of the present disclosure will now be provided with reference to FIG. 5.

Figure 5:
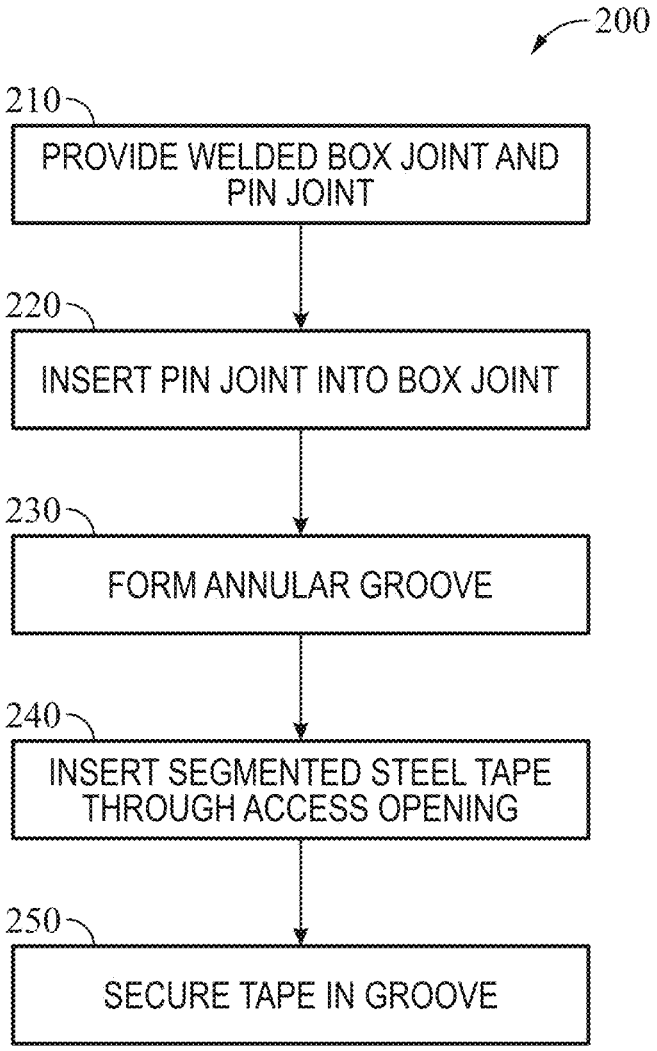
FIG. 5 illustrates a flowchart showing the method of assembling the mechanical joint assembly of FIG. 1 for connecting tubular steel piles, according to some embodiments.

FIG. 5 illustrates a flowchart 200 of an example method for assembling the mechanical joint assembly 100 of FIG. 1 to achieve reliable mechanical connections for tubular steel pile applications. The method 200 outlines the operational sequence involved in achieving controlled assembly and connection characteristics, ensuring proper performance across various pile installation applications within marine, bridge, infrastructure, and foundation construction projects.

The method 200 begins at operation 210, which involves providing welded box joint and pin joint components during preparation for field assembly. During this phase, the box joint 102 arrives at the installation site welded to a first tubular steel pile while the pin joint 104 arrives welded to a second tubular steel pile. Both coupling members are fabricated and welded in controlled environments, eliminating field welding requirements and associated quality control complexities. In some embodiments, the box joint 102 and pin joint 104 may be welded using automated welding processes for consistent quality. In some embodiments, the coupling members may incorporate corrosion-resistant coatings applied during fabrication.

Operation 220 involves inserting the pin joint into the box joint during field assembly operations. The pin joint 104 inserts into the receiving cavity of the box joint 102 through gravitational forces or light mechanical assistance, positioning the outer cylindrical surface 110 within the inner cylindrical surface 108. This insertion creates proper spacing relationships between the coupling members without requiring precise alignment or specialized equipment. In some embodiments, the pin joint 104 may include lead-in features for simplified insertion. In some embodiments, alignment guides may be incorporated to prevent rotational misalignment during insertion.

At operation 230, the annular groove forms automatically between the coupling members when insertion is complete. The annular groove is formed as the space between the inner annular recess 114 of the box joint 102 and the outer annular recess 112 of the pin joint 104. This groove formation occurs through the geometric relationship of the coupling members rather than requiring additional assembly steps or adjustments. In some embodiments, the groove dimensions may be verified using simple measurement tools. In some embodiments, O-rings may be positioned at non-contacting interfaces to produce watertight joints.

Operation 240 involves inserting the segmented steel tape through the access opening into the annular groove. The segmented steel tape 106 enters through the access opening 116 and positions within the annular groove formed by the annular recesses 112 and 114 using manual installation techniques. The segmented steel tape comprises a plurality of slits that enable the tape to conform to a circumference of the annular groove during insertion. The slits allow the tape to bend and follow the circular path while maintaining structural integrity for load transfer applications. In some embodiments, the segmented steel tape 106 may be greased to facilitate insertion without compromising joint integrity. In some embodiments, two tape segments may be inserted in opposite directions through the access opening to complete full circumference coverage.

At operation 250, the tape is secured in the groove to complete the mechanical connection. The segmented steel tape 106 is hammered into position within the annular groove formed by the annular recesses 112 and 114 to facilitate bending and conforming to the circumference. This securing process creates the mechanical lock between the box joint 102 and pin joint 104, transferring tensile loading through distributed contact rather than concentrated stress points. The completed connection provides load transfer capacity that exceeds the tensile capacity of the connected tubular steel piles. In some embodiments, an end cap may be bolted into the access opening 116 to prevent the segmented steel tape from backing out and to reinforce the mechanical joint. In some embodiments, the installation may be verified through visual inspection or load testing procedures.

The method 200 provides a field assembly approach that eliminates expensive and time-consuming field welding operations while maintaining sufficient connection strength. The use of pre-welded coupling members with segmented steel tape insertion creates reliable mechanical connections that function effectively across diverse tubular steel pile applications. This method eliminates the need for qualified welders, 100% weld inspection, and weather-dependent installation limitations while reducing installation time from hours to minutes.

The method enables installation using standard construction tools and techniques, providing flexibility across various project requirements and environmental conditions. The mechanical connection approach maintains consistent quality through factory-controlled coupling fabrication while simplifying field operations to basic insertion and hammering procedures.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

In this disclosure, the descriptions of the various embodiments have been presented for purposes of illustration and are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein. Thus, the appended claims should be construed broadly, to include other variants and embodiments, which may be made by those skilled in the art.

It will be appreciated by persons skilled in the art that the present embodiment is not limited to what has been particularly shown and described hereinabove. A variety of modifications and variations are possible considering the above teachings without departing from the following claims.

I claim:

1. A mechanical joint system for connecting tubular steel piles, wherein each of the tubular steel piles comprises an outer wall surrounding an inner hollow opening, the mechanical joint system comprising:

a box joint comprising an outer coupling member configured to be welded to a first tubular steel pile, wherein the box joint comprises an inner cylindrical surface defining a receiving cavity;

a pin joint comprising an inner coupling member configured to be welded to a second tubular steel pile, wherein the pin joint comprises an outer cylindrical surface configured for insertion into the receiving cavity of the box joint, wherein when the pin joint is inserted into the receiving cavity of the box joint an annular groove is formed between the inner annular recess of the box joint and the outer annular recess of the pin joint;

a segmented steel tape comprising a width, a thickness, and a plurality of slits across the width, wherein the segmented steel tape is configured to be inserted into the annular groove to conform to a circumference of the joint, wherein the plurality of slits enable the segmented steel tape to bend and follow the circumference of the annular groove to transfer tensile loading between the box joint and the pin joint; and at least one access opening in the pin joint configured to enable insertion of the segmented steel tape into the annular groove.

2. The system of claim 1, wherein the segmented steel tape is inserted into the annular groove by hammering the tape to facilitate bending and conforming to the circumference of the joint.

3. The system of claim 1, wherein the at least one access opening further comprises an end cap configured to be secured over the access opening to prevent the segmented steel tape from backing out of the annular groove.

4. The system of claim 3, wherein the end cap is bolted into the access opening to further reinforce the joint.

5. The system of claim 1, wherein the plurality of slits are configured to a predetermined depth based on a radius of the joint, a width of each slit, and ductility of the segmented steel tape material.

6. The system of claim 1, wherein the segmented steel tape comprises two tape segments configured to be inserted in opposite directions through the at least one access opening to complete a full circumference of the annular groove.

7. The system of claim 1, wherein the box joint and the pin joint are configured to maintain an outside diameter of the connected tubular steel piles.

8. The system of claim 1, wherein the box joint and the pin joint are configured to maintain an inside diameter of the connected tubular steel piles to eliminate flow restrictions.

9. The system of claim 1, further comprising O-rings positioned at non-contacting interfaces between the box joint and the pin joint to produce a watertight joint.

10. The system of claim 1, wherein the segmented steel tape is greased to facilitate insertion into the annular groove without compromising integrity of the joint.

11. The system of claim 1, wherein the segmented steel tape has a cross-sectional area configured to provide shear capacity and contact area sufficient to transfer tensile loading that exceeds a tensile capacity of the tubular steel piles being connected.

12. A segmented steel tape for use in a mechanical joint connecting tubular steel piles, the segmented steel tape comprising:

a steel member comprising a width, a thickness, and a length, wherein the steel member is configured to be inserted into an annular groove formed between coupling elements of the mechanical joint;

a plurality of slits comprising cuts across the width of the steel member, wherein each of the plurality of slits extends from a first edge of the steel member toward a second edge of the steel member, wherein the plurality of slits are spaced along the length of the steel member;

wherein the plurality of slits enable the steel member to bend in a horizontal plane and conform to a circumference of the annular groove when inserted therein, wherein the steel member is configured to transfer tensile loading between the coupling elements when positioned within the annular groove; and wherein the plurality of slits comprise a predetermined depth based on a radius of curvature required for the steel member to conform to the circumference of the annular groove.

13. The segmented steel tape of claim 12, wherein at least one of the plurality of slits comprises a drilled hole at an end of the slit to reduce crack propagation.

14. The segmented steel tape of claim 12, wherein the steel member comprises a cross-sectional area sized to provide shear capacity and contact area sufficient to transfer tensile loading greater than a tensile capacity of the tubular steel piles.

15. The segmented steel tape of claim 12, wherein the plurality of slits are spaced at regular intervals along the length of the steel member.

16. The segmented steel tape of claim 12, wherein the steel member is configured to be greased to facilitate insertion into the annular groove.

17. The segmented steel tape of claim 12, wherein the predetermined depth of the plurality of slits is based on ductility of the steel member material and a width of each slit.

18. A method for connecting tubular steel piles via a mechanical joint, the method comprising:

providing a box joint welded to a first tubular steel pile and a pin joint welded to a second tubular steel pile;

inserting the pin joint into a receiving cavity of the box joint to form an annular groove between the box joint and the pin joint;

inserting a segmented steel tape through an access opening in the pin joint into the annular groove, wherein the segmented steel tape comprises a plurality of slits that enable the tape to conform to a circumference of the annular groove; and securing the segmented steel tape within the annular groove to transfer tensile loading between the box joint and the pin joint.

19. The method of claim 18, wherein inserting the segmented steel tape comprises hammering the segmented steel tape into the annular groove to facilitate bending and conforming to the circumference.

20. The method of claim 18, further comprising securing an end cap over the access opening to prevent the segmented steel tape from backing out of the annular groove and to reinforce the mechanical joint.

* * * * *